US009358554B2

(12) United States Patent
Pitkämäki et al.

(10) Patent No.: US 9,358,554 B2
(45) Date of Patent: Jun. 7, 2016

(54) HERMETIC CENTRIFUGAL SEPARATOR WITH AN OUTLET PUMPING CONFIGURATION

(75) Inventors: Jouko Pitkämäki, Eskilstuna (SE); Robert Sandblom, Älvsjö (SE)

(73) Assignee: Alfa Laval Corporate AB, Lund (SE)

( * ) Notice: Subject to any disclaimer, the term of this patent is extended or adjusted under 35 U.S.C. 154(b) by 1044 days.

(21) Appl. No.: 13/505,902

(22) PCT Filed: Nov. 3, 2010

(86) PCT No.: PCT/SE2010/051194

§ 371 (c)(1), (2), (4) Date: Jul. 13, 2012

(87) PCT Pub. No.: WO2011/056131

PCT Pub. Date: May 12, 2011

(65) Prior Publication Data

US 2012/0295782 A1 Nov. 22, 2012

(30) Foreign Application Priority Data

Nov. 6, 2009 (SE) ..... 0950840

(51) Int. Cl.

*B04B 11/08* (2006.01)
*B04B 7/12* (2006.01)
*B04B 1/08* (2006.01)

(52) U.S. Cl.

CPC ..... *B04B 11/082* (2013.01); *B04B 1/08* (2013.01); *B04B 7/12* (2013.01)

(58) Field of Classification Search

CPC ..... B04B 1/08; B04B 11/08; B04B 11/082; B04B 7/12; B04B 11/02; B04B 11/06

USPC ..... 494/1–3, 56, 57, 68–73

See application file for complete search history.

(56) References Cited

U.S. PATENT DOCUMENTS 1,906,457 A * 5/1933 Flowers ..... B04B 11/06 494/66
2,171,136 A * 8/1939 Bergner ..... 494/64

(Continued)

FOREIGN PATENT DOCUMENTS

CA 2480236 A1 3/2005
DE 3731229 A1 3/1989

(Continued)

OTHER PUBLICATIONS

International Search Report for PCT/SE10/051194, dated Mar. 16, 2011.

*Primary Examiner* — Charles Cooley
(74) *Attorney, Agent, or Firm* — MKG, LLC

(57) ABSTRACT

A hermetic centrifugal separator includes a centrifuge rotor, which is arranged to rotate around a center axis and includes a casing which defines an inner separation space, a set of separation discs in the inner separation space, two or more channels which connect to the separation space and include one or more inlet channels for supply of a liquid mixture of components to be separated to the separation space and one or more outlet channels for discharge of a component. The separator includes a torque transmitting part around the center axis and fixedly connected to the centrifuge rotor and an outlet seal between the outlet channel and the rotating centrifuge rotor preventing entrainment of unwanted substances. The separator includes a pump arranged to provide pressure to feed the separated liquid through the outlet channel.

10 Claims, 4 Drawing Sheets

(56) References Cited

U.S. PATENT DOCUMENTS

| | | | | | |
|---|---|---|---|---|---|
| 2,230,210 | A * | 1/1941 | Brecour et al. | 261/4 | |
| 3,052,401 | A | 12/1958 | Thylefors | | |
| 3,244,361 | A * | 4/1966 | Lundahl | A23C 7/00 | 426/519 |
| 3,365,128 | A * | 1/1968 | Townsend, Jr. | 494/43 | |
| 3,371,858 | A * | 3/1968 | Shapiro | 494/27 | |
| 3,572,582 | A | 3/1971 | Seielstad | | |
| 3,924,804 | A | 12/1975 | Niemeyer | | |
| 3,963,175 | A * | 6/1976 | Daubman | B04B 11/06 | 494/43 |
| 4,017,023 | A * | 4/1977 | Hemfort | 494/41 | |
| 4,210,275 | A * | 7/1980 | Zettier | 494/4 | |
| 4,525,155 | A * | 6/1985 | Nilsson | B04B 1/10 | 494/10 |
| 6,033,356 | A * | 3/2000 | Mackel et al. | 494/70 | |
| 6,623,417 | B1 * | 9/2003 | Zettier | 494/57 | |
| 7,041,045 | B2 * | 5/2006 | Thiemann | 494/56 | |
| 7,306,556 | B2 * | 12/2007 | Pitkamaki et al. | 494/67 | |
| 2004/0242395 | A1 * | 12/2004 | Thiemann | 494/56 | |
| 2007/0032363 | A1 * | 2/2007 | Pitkamaki | B04B 1/08 | 494/67 |
| 2012/0295782 | A1 * | 11/2012 | Pitkamaki et al. | 494/41 | |

FOREIGN PATENT DOCUMENTS

| | | | | |
|---|---|---|---|---|
| DE | 3936150 | A1 | | 6/1990 |
| DE | 19613215 | C1 | | 9/1997 |
| FR | 2070522 | A5 | * | 9/1971 |
| GB | 434006 | | | 2/1935 |
| GB | 448229 | | * | 6/1936 |
| GB | 494211 | | * | 10/1938 |
| JP | 56133059 | | | 10/1981 |
| SU | 1595332 | | * | 9/1990 |
| WO | WO 2011056131 | A1 | * | 5/2011 |

* cited by examiner

HERMETIC CENTRIFUGAL SEPARATOR WITH AN OUTLET PUMPING CONFIGURATION

FIELD OF THE INVENTION

The present invention relates to a hermetic centrifugal separator for centrifuging components contained in a liquid mixture and having different density.

More particularly, the invention relates to such hermetic centrifugal separators comprising a rotating centrifuge rotor, which is arranged to rotate around a central axis and comprises a casing which defines an inner separation space, a set of separation discs which are provided in the inner separation space of the centrifuge rotor. The hermetic centrifuge has at least two channels, which connect to the separation space and comprise at least one inlet channel for supply of the liquid mixture of components to be separated to the separation space and at least one outlet channel for discharge of a component separated during operation from the separation space. The hermetic centrifuge has a torque transmitting part around the central axis and fixedly connected to the centrifuge rotor adapted to be driven in such a way that the centrifuge rotor is brought to rotate. The hermetic centrifuge has outlet sealing means arranged to seal between the outlet channel and the rotating centrifuge rotor preventing entrainment of unwanted substances,

BACKGROUND

In certain separator applications, the separation fluid during the separation process is kept under special hygienic conditions and/or without any air entrainment and high shear forces, such as when the separated product is sensitive to such influence. Examples of that kind are separation of dairy products, beer and in biotechnology applications. For such applications, so called hermetic separators have been developed and in production for a number of years.

In a hermetic separator, the separator bowl or centrifuge rotor is completely filled with liquid during operation. This means that no air or free liquid surfaces is meant to be present in the bowl. As can be seen in FIG. 1 which discloses a previously known hermetic centrifugal separator, the fluid to be separated enters the centrifuge rotor 1 from the bottom through a hollow spindle pipe 2 forming a hermetic inlet 3. This provides a gentle acceleration of the fluid having shear-sensitive contents. The feed is then accelerated in a distributor 4 before entering a disc stack 5 comprising separator discs where the separation takes place. The liquid phase moves towards the center of the centrifuge rotor 1, where the liquid phase is pumped out under pressure by means of a built-in pump disc 6 to at least obtain a required outlet pressure. The separated heavier solids phase is collected at the periphery of the centrifuge rotor 1, from where the solids are discharged intermittently through solids ports 7.

However, the pressure drop inside the separator is not reduced. The main part of this pressure drop arises in the narrow section where the fluid passes the outlet sealing.

In order to create a flow of process fluid through a hermetic separator, an inlet pressure has to be provided to overcome the pressure drop in the separator. The inlet pressure required at a certain capacity is often higher than desired. This provides a problem, especially within areas with a requirement of soft treatment of the process fluid such as biotechnology. Thus, a contradiction between high capacity and quality of separation product appears.

In beer separation, the required inlet pressure can be high, caused by carbon dioxide leaving the fluid which in its turn may cause cavitation. It also leads to capacity problems, as the process fluid flow will be reduced.

A part of the pressure drop over the separator arises in the narrow section where the fluid passes the outlet sealing.

SUMMARY OF THE PRESENT INVENTION

It is an aim of the present invention to provide a hermetic separator which reduces the above-mentioned problems of the present technology.

This and other aims are achieved, according to the present invention, by that between said separation space and said outlet sealing means, a pumping means is arranged to provide pressure to feed the separated liquid through said outlet channel.

In an embodiment of the present invention, the pumping means is a non-rotating stationary arrangement adapted to direct the separated liquid inwardly towards the center axis in order to increase the pressure in the outlet channel.

In another embodiment of the present invention, the pumping means comprises radially extended arc-formed teeth directed in a counter-rotational direction.

In yet another embodiment of the present invention, the pumping means also comprises a stem-like member which by a first end is attached to a stationary part of the separator and from a second end of which the arc-formed teeth extend.

In a further embodiment of the present invention, said pumping means further comprises a disc which disc with its center of its surface facing away from the separation space is attached perpendicularly to the second end, and where the disc is at least in contact with the arc-formed teeth.

In another embodiment of the present invention, the arc-formed teeth are evenly spaced along the circumference of the disc and are identically curved.

In another embodiment of the present invention, the arc-formed teeth extend outside the periphery of the disc.

In yet another embodiment of the present invention, the arc-formed teeth are attached to the surface of the disc.

BRIEF DESCRIPTION OF THE DRAWINGS

The invention is now being explained more in detail by means of a description of advantageous embodiments, which are examples of possible realizations of the present invention, and with reference to the drawings attached hereto.

DETAILED DESCRIPTION

A centrifugal separator comprises a stationary frame. The frame comprises a base intended to be located on a suitable substrate, such as a floor, and a stationary casing which is provided on the frame. The centrifugal separator comprises a rotating torque transmitting part, which is journalled in the frame and which extends along a center axis. The torque transmitting part is driven by a drive motor which may be an electric, hydraulic or pneumatic drive motor.

The centrifugal separator also comprises a centrifuge rotor, which is fixedly attached on the torque transmitting part. The centrifuge rotor is provided in the stationary casing and is provided with a rotor casing defining an inner separation space.

Figure 1:
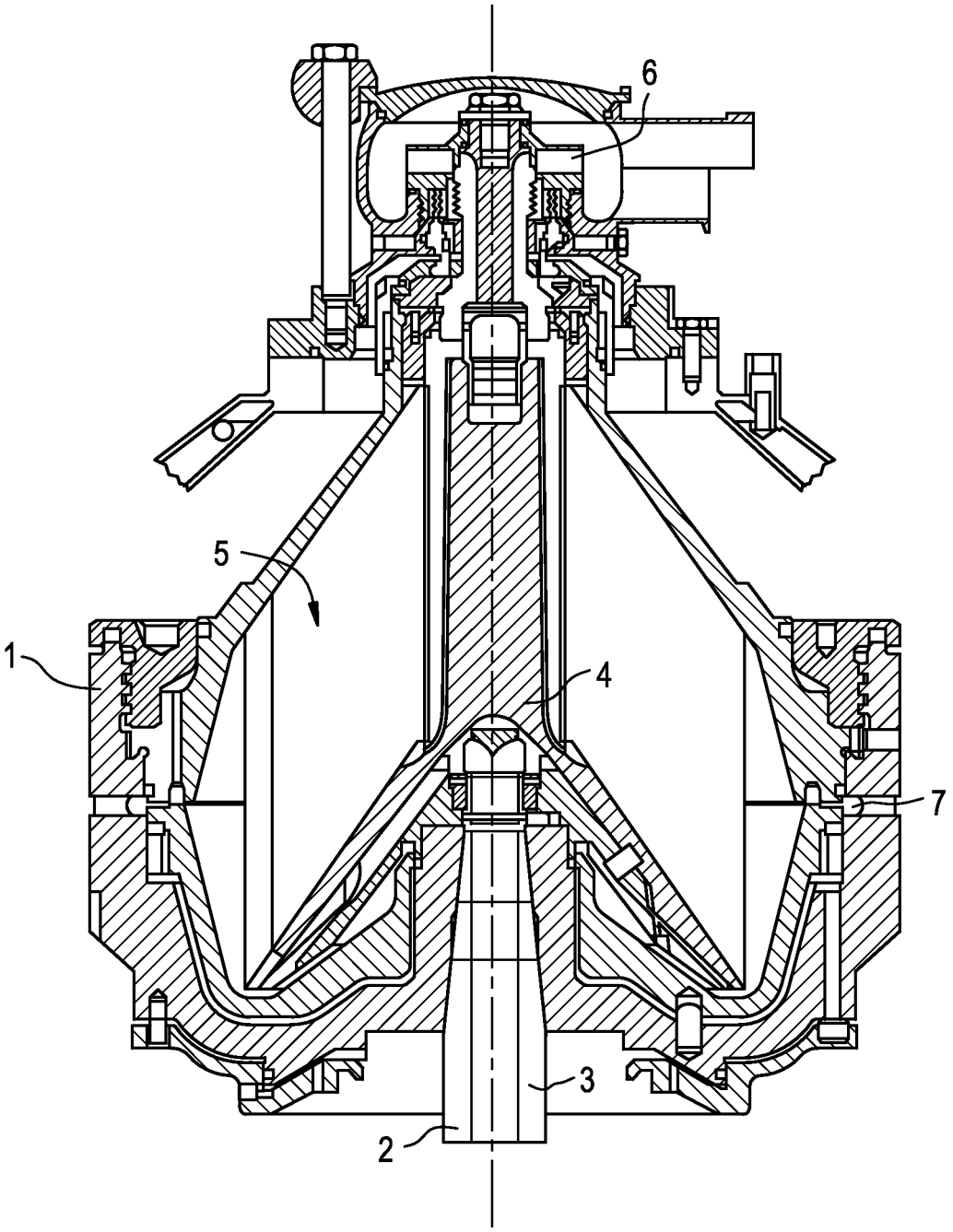
FIG. 1 PRIOR ART
FIG. 1 is a schematic side view of a hermetic centrifugal separator according to prior art.
Figure 2A:
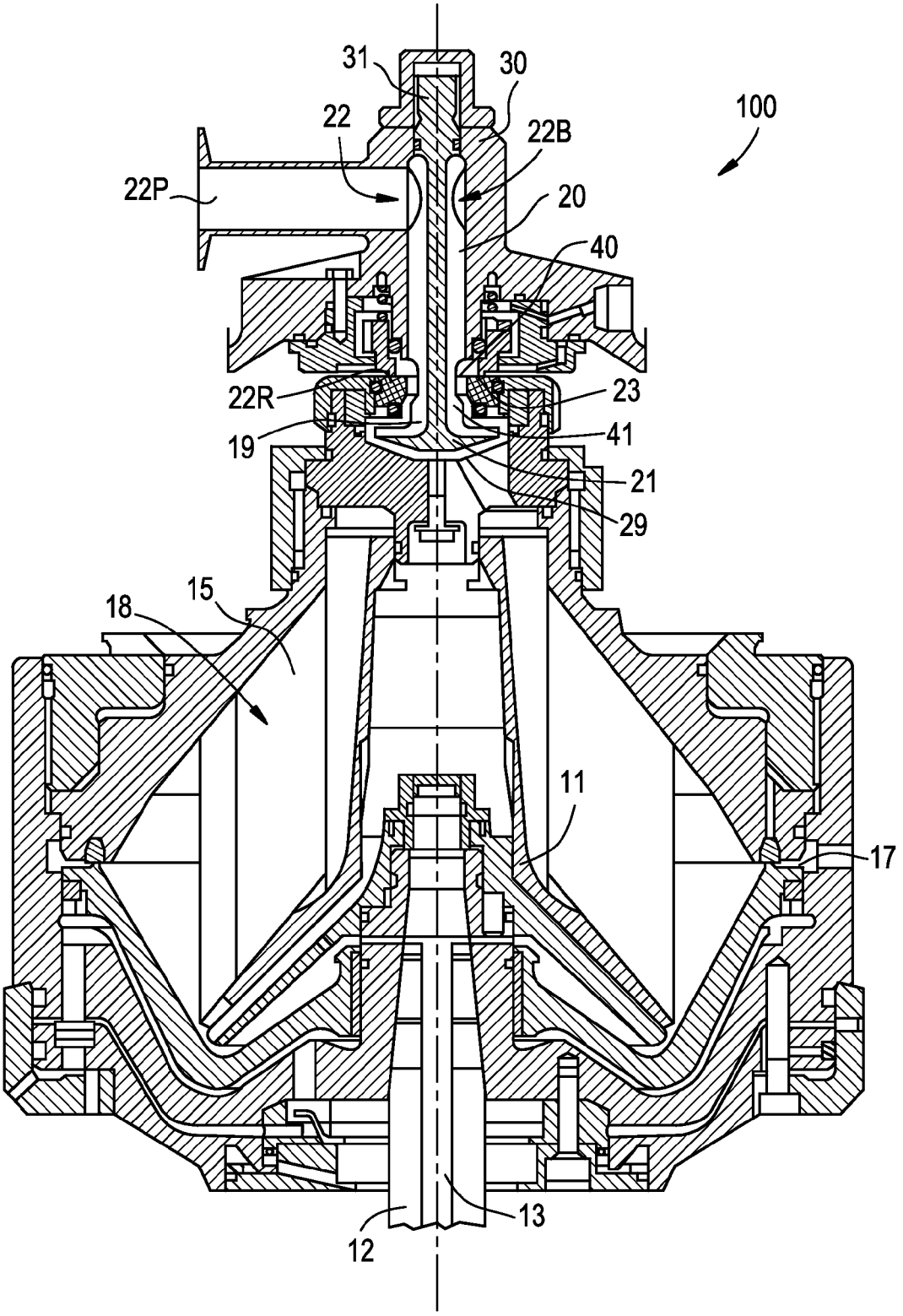
FIG. 2A is a schematic side view of a hermetic centrifugal separator according to the present invention.
Figure 2B:
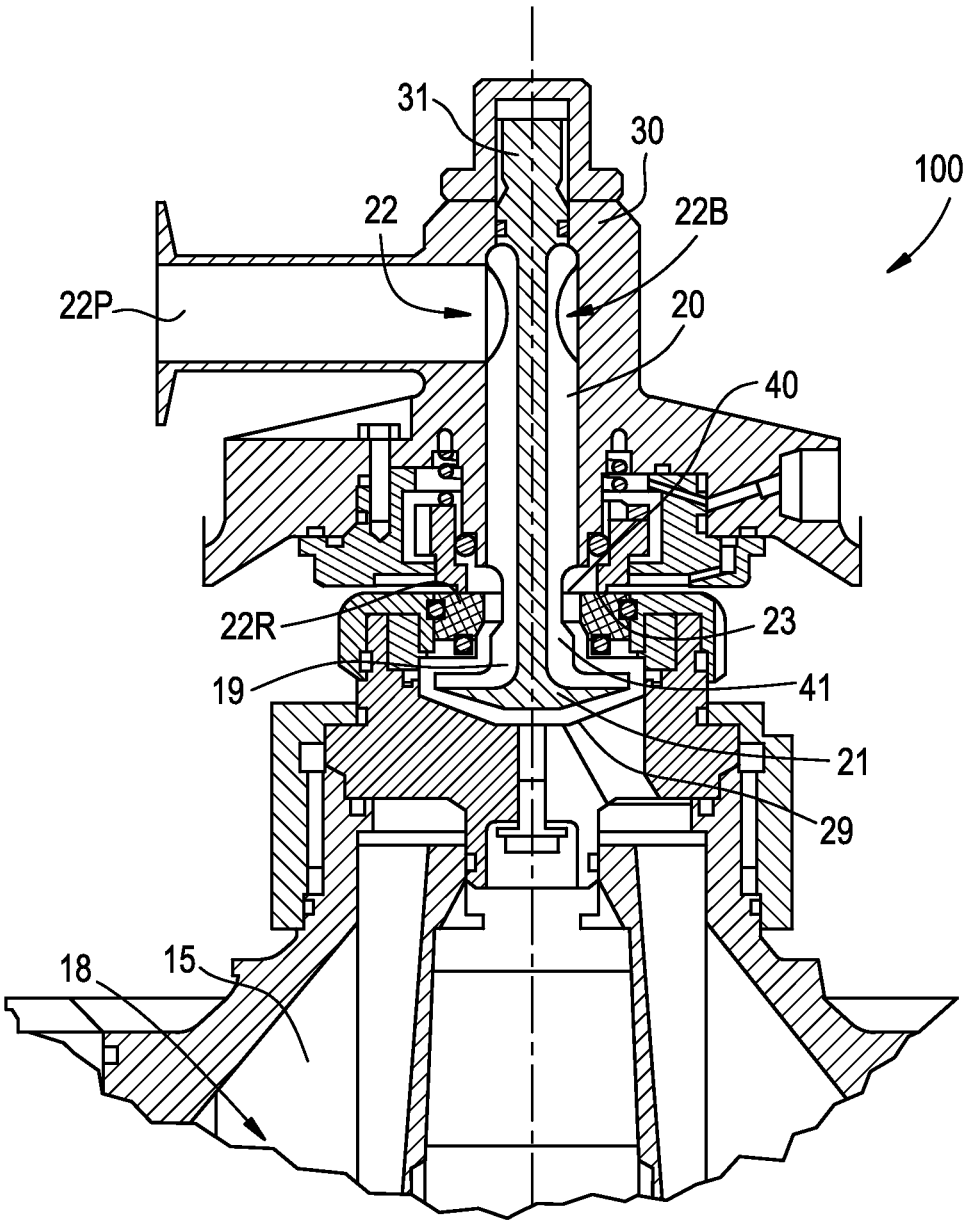
FIG. 2B is an enlarged view of a portion of the hermetic centrifugal separator of FIG. 2A.
Figure 3:
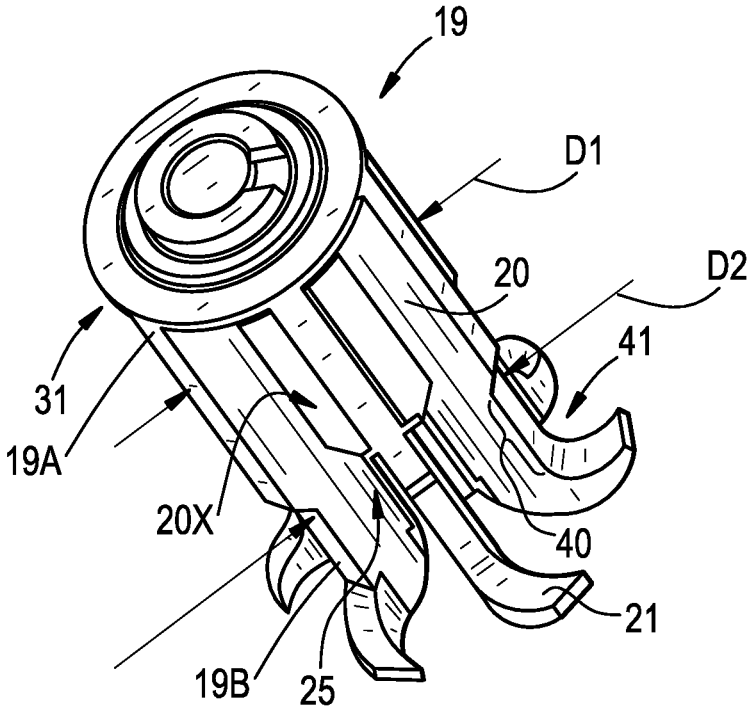
FIG. 3 is a perspective view of a part of the pumping means according to an embodiment of the present invention.

FIGS. 2A and 2B discloses a vertical sectional view of a preferred embodiment of a hermetical separator 100 according to the present invention. In the embodiment in FIGS. 2A and 2B, the centrifugal separator 100 comprises a centrifuge rotor 11, which is fixedly attached on a torque transmitting part 12 designed as a hollow spindle in which an inlet channel 13 is arranged. The inlet channel 13 is provided to supply separation fluid into a separation space 18 in the centrifugal separator 100, which fluid is to be cleaned by centrifugal separation. The centrifugal separator 100 also comprises a disc stack 15 comprising a set of separation discs which are provided in the inner separation space 18 of the centrifugal separator 100 and rotate with the centrifuge rotor 11. In one embodiment, the discharge of the cleaned product takes place through an outlet channel 22 at the upper end of the centrifuge rotor 11. The outlet channel 22 is defined by a bore 22B of the stationary casing 30, an area of reduced cross section 22R of the bore 22R and an outlet branch 22P. In a narrow passage (e.g., the area of reduced cross section 22R) of the outlet channel 22 is an outlet sealing 23 arranged for sealing off the outlet channel 22 from the centrifuge rotor 11 to preclude possible penetration of air and contamination from the environment. A pumping means 19 arranged in the bore 22B with a portion thereof proximate a chamber 29 that is in communication with the separation space 18. In the embodiment disclosed in FIGS. 2A and 2B and FIG. 3, the pumping means 19 is defined by an elongate cylindrical body having a plurality of legs 20 (e.g., stem-like members). Each of the legs 20 axially extend from a base 31 towards a terminal end 41 of the cylindrical body. The legs 20 are attached to the center of a disc 25. Each of the legs 20 extend from a surface of the disc 25 facing away from the separation space 18. The base 31 is attached to the stationary casing 30. The pumping means 19 extends through the bore 22B and has a symmetry axis coinciding with an extension of the rotational axis of the centrifugal rotor 11. Adjacent pairs of the legs define an axial extending opening 20X therebetween. The cylindrical body defines a first surface 19A proximate the base 31. The first surface 19A has a first diameter D1. The cylindrical body has an area of reduced cross section 40 includes a second surface 19B defined by a second diameter D2. The area of reduced cross section 40 is located between the first surface 19A and the terminal end 41. The second diameter D2 is of a lesser magnitude than the first diameter D1. The area of reduced cross section 40 is proximate the area of reduced cross section 22R of the bore 22B. Each of the legs 20 has a radially outward and circumferentially curved extension 21 (e.g., radially outwardly arc-formed teeth) proximate the terminal end 41. The surface of the disc 25 is in contact with the circumferentially curved extensions 21 which thus form arc-formed ridges protruding from the surface. The circumferentially curved extensions 21 are evenly spaced along the circumference of the disc 25 and may be identically curved and may as in FIGS. 2A and 2B extend outside the periphery of the disc 25. The circumferentially curved extensions 21 (e.g., arc-formed teeth) are directed in a counter-rotational direction. In one embodiment, the circumferentially curved extensions 21 (e.g., arc-formed teeth) are attached to the surface of the disc 25.

The function of the pumping means 19 is as follows. The rotating separated fluid is led from the separation space 18 to the chamber 29 and as it still has rotational energy it is rotating in the chamber 29. The arc-formed teeth 21 are leading a certain amount of the rotating fluid along the arc-shapes inwardly towards the stem-like member 20 and the center axis. Some of the kinetic energy in the rotating fluid is thus converted to pressure energy by the pumping means 19. The fluid is further led along the stem-like member 20 past the narrow passage where the outlet sealing 23 is situated and further to an outlet orifice in the outlet channel 22. The pumping means 19 is thus compensating for the pressure drop caused by the narrow passage of the outlet sealing 23.

The invention is not limited to the embodiments disclosed but may be varied and modified within the scope of the following claims.

What is claimed is:

1. A hermetic centrifugal separator for centrifuging components, contained in a liquid mixture and having different density, comprising:

a rotating centrifuge rotor, which is arranged to rotate around a central axis and comprises a casing which defines an inner separation space;

a set of separation discs which are provided in the inner separation space of the centrifuge rotor;

at least two channels, which connect to the separation space and comprise at least one inlet channel for supply of the liquid mixture of components to be separated to the separation space and at least one outlet channel for discharge of a component separated during operation from the separation space;

a torque transmitting part around the central axis and fixedly connected to the centrifuge rotor adapted to be driven in such a way that the centrifuge rotor is brought to rotate;

outlet sealing means arranged to seal between the outlet channel and the rotating centrifuge rotor preventing entrainment of unwanted substances;

between said separation space and said outlet sealing means is a pumping means comprising an elongate cylindrical body and having a plurality of legs, each of the legs axially extending from a base towards a terminal end of the cylindrical body, each of the legs has a radially outward and circumferentially curved extension proximate the terminal end, adjacent pairs of the legs defining an axial extending opening therebetween, the cylindrical body defining a first surface proximate the base, the first surface having a first diameter, the cylindrical body having an area of reduced cross section defined by a second diameter, the area of reduced cross section being located between the first surface and the terminal end, the second diameter being of a lesser magnitude than the first diameter, the pumping means being arranged to provide pressure to feed the separated liquid through said outlet channel; and the pumping means is a non-rotating stationary arrangement disposed in a chamber that is in direct fluid communication with the inner separation space such that the separated liquid has rotational energy and so that a portion of the pumping means is adapted to direct the separated liquid inwardly towards the center axis in order to increase the pressure in the outlet channel.

2. The centrifugal separator according to claim 1, wherein each of the radially outward and circumferentially curved extensions comprise radially extended arc-formed teeth directed in a counter-rotational direction.

3. The centrifugal separator according to claim 2, wherein the base is attached to a stationary part of the separator.

4. The centrifugal separator according to claim 3, wherein said pumping means further comprises a disc which disc with its center of its surface facing away from the separation space is attached perpendicularly to said terminal end, and where said disc is at least in contact with said arc-formed teeth.

5. The centrifugal separator according to claim 4, wherein said arc-formed teeth are evenly spaced along the circumference of the disc and are identically curved.

6. The centrifugal separator according to claim 4, wherein said arc-formed teeth extend outside a peripheral area of the disc.

7. The centrifugal separator according to claim 4, wherein said arc-formed teeth are attached to said surface of the disc.

8. The centrifugal separator according to claim 1, wherein the torque transmitting part comprises a hollow spindle in which the at least one inlet channel is arranged.

9. The centrifugal separator according to claim 1, wherein the sealing means is positioned around a portion of the pumping means.

10. The centrifugal separator according to claim 1, wherein the sealing means is positioned proximate the area of reduced cross section.

* * * * *